US009982439B2

(12) United States Patent
Essig

(10) Patent No.: US 9,982,439 B2
(45) Date of Patent: May 29, 2018

(54) ROOF PAVER LOCKING SYSTEM AND METHODS FOR INSTALLING PAVERS

(71) Applicant: Daniel Essig, Davie, FL (US)

(72) Inventor: Daniel Essig, Davie, FL (US)

( * ) Notice: Subject to any disclaimer, the term of this patent is extended or adjusted under 35 U.S.C. 154(b) by 0 days. days.

(21) Appl. No.: 15/605,300

(22) Filed: May 25, 2017

(65) Prior Publication Data

US 2017/0260750 A1 Sep. 14, 2017

Related U.S. Application Data

(63) Continuation of application No. PCT/US2015/064568, filed on Dec. 8, 2015.

(60) Provisional application No. 62/089,400, filed on Dec. 9, 2014.

(51) Int. Cl.
*E04D 13/12* (2006.01)
*E04F 15/024* (2006.01)
*E04F 15/02* (2006.01)

(52) U.S. Cl.
CPC ..... *E04D 13/12* (2013.01); *E04F 15/02183* (2013.01); *E04F 15/02405* (2013.01); *E04F 15/02452* (2013.01)

(58) Field of Classification Search
CPC ..... E04D 13/12; E04F 15/02183; E04F 15/02452; E04F 15/02405; E04F 15/0247; E04F 15/02476; E04F 15/02464
See application file for complete search history.

(56) References Cited

U.S. PATENT DOCUMENTS

| | | | | |
|---|---|---|---|---|
| 5,501,754 | A * | 3/1996 | Hiraguri | E04F 15/02452 156/71 |
| 6,520,471 | B2 | 2/2003 | Jones et al. | |
| 6,604,330 | B2 | 8/2003 | Repasky | |
| 7,140,156 | B1 * | 11/2006 | Lowe, Jr. | E04F 15/02183 411/457 |
| 7,536,802 | B1 | 5/2009 | Tavy et al. | |
| 7,770,345 | B2 | 8/2010 | McConnell et al. | |
| 2002/0144477 | A1 * | 10/2002 | Chen | E04F 15/02476 52/263 |
| 2004/0250435 | A1 | 12/2004 | Fiore | |
| 2004/0261329 | A1 * | 12/2004 | Kugler | E04F 15/02183 52/126.6 |

FOREIGN PATENT DOCUMENTS

| | | | |
|---|---|---|---|
| WO | 0112918 | A1 | 2/2001 |
| WO | 2006087572 | A1 | 8/2006 |

* cited by examiner

*Primary Examiner* — Babajide A Demuren
(74) *Attorney, Agent, or Firm* — Laurence A. Greenberg; Werner H. Stemer; Ralph E. Locher

(57) ABSTRACT

An apparatus and methods lock together pavers on a roof deck to reduce uplift pressure and increase stability and strength in a variety of environmental conditions. More specifically, a paver lock apparatus is placed in grooves on the top side of a multiple of pavers and locked to a stationary object, such as the roof or a pedestal placed on the roof underneath the deck. Roof pavers are manufactured with grooves on the paver surface to hold the paver lock apparatus. The pavers are loose laid on paver pedestals and the paver lock apparatus is laid into the grooves of multiple adjacent pavers and locked into place by connecting the paver lock apparatus to the paver pedestal.

20 Claims, 9 Drawing Sheets

ROOF PAVER LOCKING SYSTEM AND METHODS FOR INSTALLING PAVERS

CROSS-REFERENCE TO RELATED APPLICATION

This application is a continuation, under 35 U.S.C. § 120, of copending international application No. PCT/US2015/064568, filed Dec. 8, 2015, which designated the United States; this application also claims the priority, under 35 U.S.C. § 119, of U.S. provisional application No. 62/089,400, filed on Dec. 9, 2014; the prior applications are herewith incorporated by reference in their entireties.

BACKGROUND OF THE INVENTION

Field of the Invention

The present disclosure describes an apparatus and a method for locking together pavers on a roof deck to reduce uplift pressure and increase stability and strength in a variety of environmental conditions. More specifically, the present disclosure provides for a paver lock apparatus containing a geometrically shaped upper frame, which is attached to a center connector point by two or more cross-braces.

Along with the growing population, especially in major cities, there has been an increased desire by residents to find adequate green spaces as well as a desire to create communal areas on high rise buildings, such as restaurants and bars, where customers can have a panoramic view of the surrounding area.

To fulfill residents' wants, a rising number of commercial office buildings, apartment complexes, and residential high-rises are now using their rooftops as rooftop gardens, patios, bars, restaurants, and residential green spaces for relaxation, personal well-being and socialization.

Additionally, rooftop spaces have a number of secondary benefits such as mitigating the detrimental effects of elevated urban temperatures, attracting wildlife and beneficial insects, absorbing airborne pollution and filtering storm water run-off.

However, rooftops are also prone to intense environmental conditions such as rain, snow, intense heat or even earthquakes as well as high traffic volume. Therefore, the placement of patios and decks along with the choice of materials used to create them must be carefully chosen to suit the environment.

Additionally, roofs on multi-story building hide important structural components, such as electrical wiring, air conditioning ducts, heating or water piping which may require maintenance or repair, so any roof patios or decking are often removable, to allow access to critical areas.

To accommodate such a diverse set of requirements, many common roof areas use a ballasted system in which heavy-weight tiles or wood, also known as pavers, are loose-laid across the common outdoor roof area, held in place purely by the weight of the paver.

Pavers can vary in shape, size, and material but are typically square, ranging from 12" to 36" in width with a thickness dependent on the paver material, but are generally 2" or less, so that they are heavy enough to avoid uplifting but at a size and strength that allows for installation by workers without the needs for heavy equipment.

The pavers are typically aligned edge-to-edge with little or no space between each paver and being loose laid, each paver can be removed as necessary to access the surface underneath.

To promote easier access to the roof surface, pavers are often placed on elevated pedestals, which are either a fixed height or are adjustable to accommodate variations in the contour of the roof surface, allowing the finished roof patio to maintain a continuously uniform flat surface in a variety of designs and styles.

Each paver rests on a portion of the pedestal so that each pedestal can hold multiple corners of adjacent pavers, creating an interlocking deck. The number of paver corners depends on the geometric shape of the paver. For example, square or rectangular pavers, aligned in a grid like a chessboard, would have a paver pedestal with four pedestal corners, each paver corner accounting for approximately one corner of the pedestal.

Additional pedestals can be positioned at other support points to accommodate larger or heavier pavers.

However, ballasted roof pavers require sufficient weight so that they are held in place during normal conditions, which means that lightweight materials that may be cheaper, easier to install or more durable would not remain in place without some type of locking mechanism.

Even ballasted pavers may not remain in place if they are subjected to extreme weather events, such as high velocity winds during hurricanes, or during other catastrophic events such as earthquakes.

This is especially true for decks or patio areas on high-rise building where the building height and shape or proximity to other building can often cause wind shears and other strong wind forces.

Certain points along the roof, such as roof edges, roof peaks or near obstructions, cause the wind to deflect away creating a significant drop in air pressure immediately above the patio surface.

The external pressure distribution on the top surface of a paver causes wind flow through the gaps between adjacent pavers as well as the space between the underside of the paver which are in contact with the pedestals.

In certain areas of the roof, such as windward edges and corners, higher pressure may exist under the pavers, resulting in a pressure differential that creates an uplift force on certain individual pavers.

When the pressure acting on the bottom surface of a paver exceeds the pressure experienced on the top surface, the paver becomes subject to the negative net pressure force (uplift force) which reduces the effect of the ballast weight. High uplift forces can cause the paver to dislodge or crack, creating destructive flying debris as well as leaving the roof and its substrate exposed to the damaging external forces.

As well, harsh conditions, such as freezing and thawing, can also cause pavers to weaken at points and crack if exposed to high uplift forces. Since, the smaller broken areas have less ballasted weight, less uplift force is required to dislodge them and in some cases, the smaller paver pieces can become dangerous flying debris.

The net pressure at which a paver may fail depends on a multitude of factors, such as paver weight, the roof area of a paver, the pavers material density and its permeability. Even 2 ft.×2 ft.×2-in. thick concrete pavers, weighing approximately 90 lbs. can be dislodged by hurricane force winds gusts of only 125 mph.

Isolated high-rise building without other high-rise structures to act as wind breaks or smaller multi-story structures located in lowland, flat geographic areas that do not have a buffer to reduce wind speed are particularly prone to damaging wind.

There are multiple methods for calculating paver strength across a multitude of conditions. For example, a method for calculating the overall wind uplift load, L(t), acting on any single paver can be obtained from the equation:

$$L(t) = \frac{1}{2}pU^2 \int\int_{A\ paver} Cp_{net}(t, x, y)\,dA \rightarrow C_L(t) = \frac{L(t)}{\frac{1}{2}pU^2A}$$

where A is the surface area of the paver and $Cp_{net}(t)-Cp_{ext}(t)-Cp_{int}(t)$ is the net total pressure coefficient defined as the instantaneous difference between the external and corresponding underneath pressure coefficient at the same location. The overturning moment about a selected axis is obtained from:

$$M(x, y, t) = \frac{1}{2}pU^2 \int\int_{A\ paver} Cp_{net}(t, x, y)\,xdA \rightarrow C_M(t) = \frac{M_{(t)}}{\frac{1}{2}pU^2AD}$$

where e(x, y) is the moment arm defined as the distance from the selected axis to each point on the paver.

The blow-off takes place when the uplift force is equal to the pavers weight W. Therefore, the critical wind velocity $U_{CRIT}$ at which the blow-off occurs is calculated from:

$$\frac{1}{2}pU_{CRIT}^2C_LA = W \rightarrow U_{CRIT} = \sqrt{\frac{W}{\frac{1}{2}pC_LA}}$$

The mean pressure coefficient at any location obtained from:

$$Cp_{mean} = \frac{P(t)_{mean}}{\frac{1}{2}pU_{mean}^2}$$

where $P(t)_{mean}$ is the time history of mean pressure, p is the air density at and U is the mean wind sped measured at the building height. For the proper securing of individual pavers, measure values of $Cp_{peak}$ should be considered because the highly fluctuating nature of wind pressures can create significant differences than might be expected in the peak pressure values even over multiple tests.

One method for determining peak pressures is that found in Sadek, F. and Simiu, E., (2002), "Peak Non-Gaussian Wind Effects for Database-Assisted Low-Rise Building Design," Journal of Engineering Mechanics, ASCE, Vol. 128(5), pp. 530-539. Estimates obtained from this approach are based on the entire information contained in a time series and are therefore more stable than estimates based on single observed peaks. The peak pressure coefficient can be obtained from:

$$Cp_{peak} = \frac{P(t)_{peak}}{\frac{1}{2}pU\frac{2}{3s}}$$

where $P(t)_{peak}$ is the peak pressure and $U_{3s}$ is the peak 3-s gust at the reference height.

Examples of additional methods for determining roof paver strength requirements at various wind speeds can be found at Aly, A. M., Bitsuamlak, G. T., and Gan Chowdhury, A. "Full-Scale Aerodynamic Testing of a Loose Concrete Roof Paver System," Engineering Structures, 44, 60-270, 2012 or Asghari Mooneghi, M., Irwin, P., Gan Chowdhury, A. (2015). Design Guidelines for Roof pavers against Wind Uplift, Structures Congress 2015, 2679-2688.

As well, those skilled in the art should consider consensus guidelines from organizations such as ASTM International, the globally recognized leader in the development and delivery of voluntary consensus standards. For example, concrete roof pavers can be constructed and placed according to Standard Specification for Concrete Roof Pavers C15.03 Active Standard ASTM C1491.

Specific tests include, but are not limited to, a 50-Cycle Freeze Thaw Test (ASTM C-67), a Coefficient of Friction Test (ASTM C1028-84), a Compression Test (ASTM C-67), and a Flexural Strength Test (ASTM-67).

It is well known by those persons skilled in the art that locking a group of loose pavers together creates a sufficient downward force on the pavers that acts together to counterbalance the net uplifting loadings caused by the wind, enhancing stability at all points across the roof.

One example of a paver locking systems is taught in U.S. Pat. No. 5,377,468, entitled "Aerodynamically Stable Roof Paver System and Ballast Block," in which rectangular ballast blocks are laid in rows and interlocked by tongue and groove edge faces. The adjacent blocks in each row form labyrinthine channels between their edge faces for drainage and equalization of air pressure above and below the blocks. To accomplish the locking mechanism, a groove is cut into the side of a paver (female) with an extruding joint (male) located on the opposite side of the paver, of a size and shape that it will fit snugly into the female groove of an adjacent paver. In this method, pavers can be held together across the entire roof area.

The tongue and groove approach has a significant drawback in that the mechanism does not work with heavyweight ballasted pavers such as those made of concrete or stone.

Another method is shown in U.S. Pat. No. 6,604,330, entitled "Ballast Block Deck System and Pedestal Assembly". A ballast block deck system includes a plurality of ballast blocks (pavers) laterally positioned to form an elevated deck on an existing roof structure. A pedestal is located directly beneath corner portions of adjacent pavers spaced across the roof as support. A corner cap is installed above the pedestal, which holds the pavers in place in the event of strong winds. The paver corners are cut out to accommodate a flat paver plate so that the plate surface is the same elevation as the paver creating a uniform surface.

The problem with the paver plate, is that, although uniform with paver surfaces at installation, plate displacement, including shifting, tilting, or being depressed below the paver surface, can occur from continuous traffic, over time, by residents or other pedestrians, especially in highly trafficked rooftop such as hotels or restaurants.

As well, exposure to the elements over time, can have a detrimental effect on the paver plate. For example, snow, ice or intense heat can cause damage to the plastic paver plate, such as warping, which weakens the plate resulting in displacement.

With the surface area of a paver plate no longer being at a level elevation with the surface of adjoining pavers, the paver plate can collect debris and other windblown material at the edge where the plate is lower than the top side of the paver and become a trip hazard.

Additionally, water may pool on the lower side of the corner plate leaving areas throughout the patio or deck where bacteria, algae and mildew can grow, and insects, such as mosquitoes, can breed.

Plate surfaces can become slippery from water runoff containing oils and other particulate matter; creating hazardous conditions.

Also, in patio or decking where pavers are lightweight materials, such as Teak, there are only minimal ballast forces exerting downward pressure. Therefore, a significantly lower upward force can dislodge a lightweight paver. In some cases, additional downward force may be required, in the form of larger plates. Large corner plates can trap additional debris or water as well as reduce a roof patio or deck's aesthetic appeal.

Although rooftop ballast block systems may function satisfactorily under certain conditions, there is a need for an improved system for locking together pavers, which can exert downward force on the pavers, reducing the effects that weather and human forces have on their stability while maintaining the desired aesthetic appeal.

BRIEF SUMMARY OF THE INVENTION

It is therefore an objective of the current invention to provide a locking system for ballasted and non-ballasted roof pavers that reduces problems found in current plate-type ballasted paver systems, while also providing increased structural stability for a roof deck or patio, in a diverse set of environments and for a wide-range of pavers and paver materials.

The roof paver locking system consist of a series of symmetrical polygonal shaped pavers, a paver lock situated above the pavers and a stationary object below the pavers to which the paver lock is attached.

To provide the counter forces necessary to hold the pavers in place during extreme environmental conditions, a paver lock is placed on the top surface of a multiple of pavers, the center of the paver lock being located on the patio or deck at the positions where the corner of the pavers meet.

The paver lock should be constructed from a non-corrosive material and lightweight material such as a polymer or stainless steel.

The paver lock is comprised of an open geometric shaped upper frame and two or more spacer arms acting as cross-braces that extend on one end from the upper frame to a center connector on the opposite end.

The center connector is located at the center of the upper frame.

The top side of the pavers contains two or more grooves diagonally spanning between either side of the pavers corner vertices.

When the pavers are placed adjacent to each other, the paver grooves form a shape around the point where the corners of multiple pavers meet and have a dimension and shape that corresponds to the dimension and shape of the upper frame.

The upper frame fits into the paver grooves so that the top of the upper frame is flush with or below the paver surface.

The paver grooves can also be slanted so that liquid and debris are channeled into the spacer seams onto the roof below.

The paver grooves can also be made wide that the upper frame to create a wider volume to collect and channel liquid and small debris toward the spacer seams and onto the roof below.

The spacer arms correspond to the space between the pavers (paver seams), so that when a paver lock is placed on top of a multiple of pavers at the pavers' corner vertices, the spacer arms are hidden within the paver seams.

The horizontal top portion of the corner vertex of the paver may also be partially removed so that the corners of a multiple of pavers form a center connector cutaway that is equal to or larger than the center connector so that the center connector may sit flush with or below the surface of the paver.

To add strength and stability to the paver lock, it should be affixed to a stationary object underneath the pavers. Traditionally, the corners of the roof pavers are placed on paver pedestals, which keep the patio or deck raised above the roof.

The paver pedestals are placed below the corners of the pavers, under the paver lock whereby a connector bolt can be fed though a connector hole in the center connector and into a hole at the top of the paver pedestal, where it can be tightened to a point that provides sufficient additional strength.

The method for deploying the roof paver locking system includes manufacturing roof pavers with paver grooves and a center connector cutaway.

The pavers are loose laid on the roof or onto the paver pedestals and the paver lock is loose laid into the paver grooves of multiple adjacent pavers.

The pavers are locked into place by connecting the paver lock to the stationary object below the patio, such as the paver pedestal.

Other features which are considered as characteristic for the invention are set forth in the appended claims.

Although the invention is illustrated and described herein as embodied in a roof paver locking system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
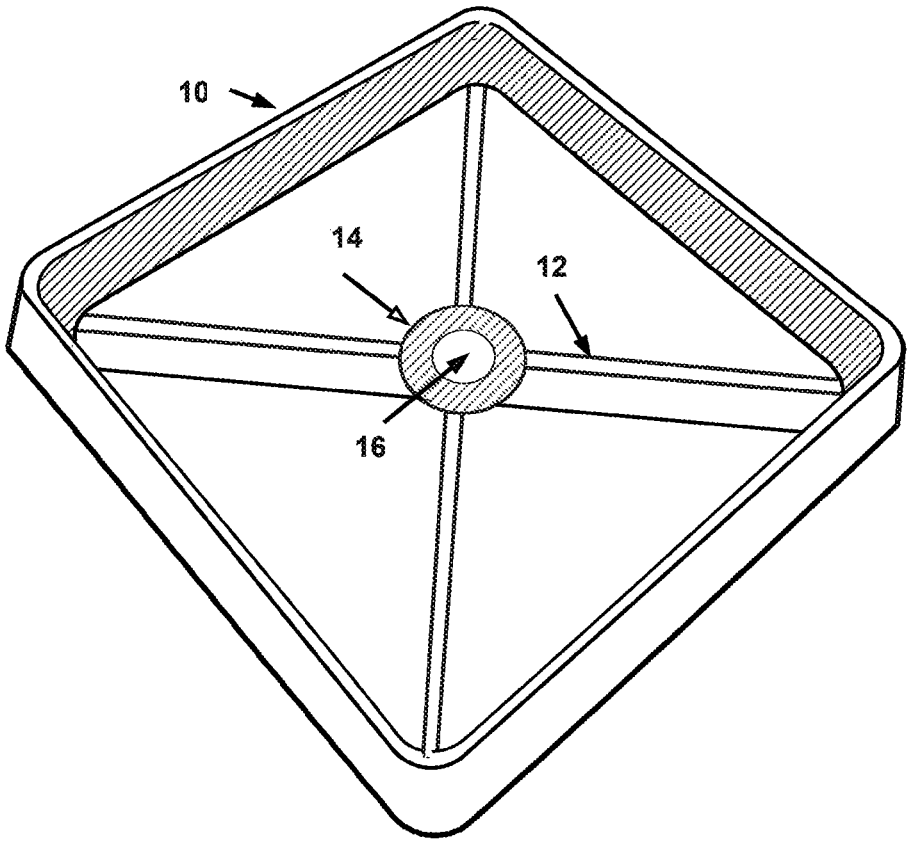
FIG. 1 is a diagrammatic, perspective view of a paver lock apparatus consisting of an upper frame, spacer arms and a center connector with a connector hole.

Referring now to the figures of the drawings in detail and first, particularly to FIG. 1 thereof, there is shown a paver lock having an upper frame 10, spacer arms 12, a center connector 14 and a connector hole 16.

The upper frame 10 is a geometric shape, such as a square, or circle, with an empty interior surface area, like a picture frame.

The upper frame 10 can vary in size, with larger sizes having a greater span and distance, allowing for greater downward pressure required to provide sufficient counterbalance against upward wind pressure, without affecting the aesthetic appeal of deck or patio surface.

The upper frame 10 can also vary in shape, creating geometric designs and patterns throughout the roof deck.

The spacer arms 12 function as cross-braces enhancing the strength of the paver lock.

In the presented embodiment there are four spacer arms 12. One end of each spacer arm 12 is connected to one corner of the upper frame 10, with the other end of the spacer arm 12 connected to the center connector 14. However, the spacer arms 12 can be connected to a plurality of points along the upper frame 10 depending upon the upper frame shape and the number and location of the paver seams.

At the center, between the four spacer arms 12 is the center connector 14.

In a preferred apparatus, the center connector 14 contains a connector hole 16.

Figure 2:
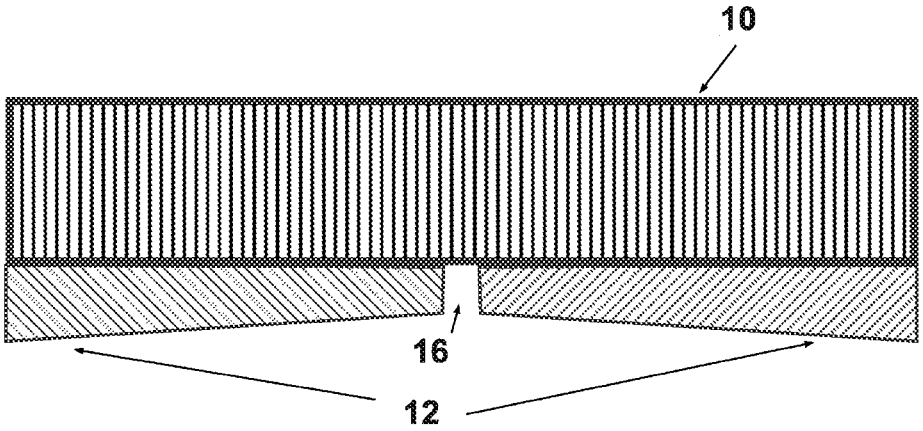
FIG. 2 is a side view of the paver lock.

FIG. 2 illustrates a side view of the paver lock. The upper rectangle is one side of the upper frame 10, with the spacer arms 12 underneath in a perspective view, moving away from the viewer. In this view, the spacer arms 12 have a uniform height.

The displayed embodiment assumes square concrete pavers, evenly distributed in symmetrical rows, like a chessboard, however, any number of patterns, shapes or sizes are contemplated.

Figure 3:
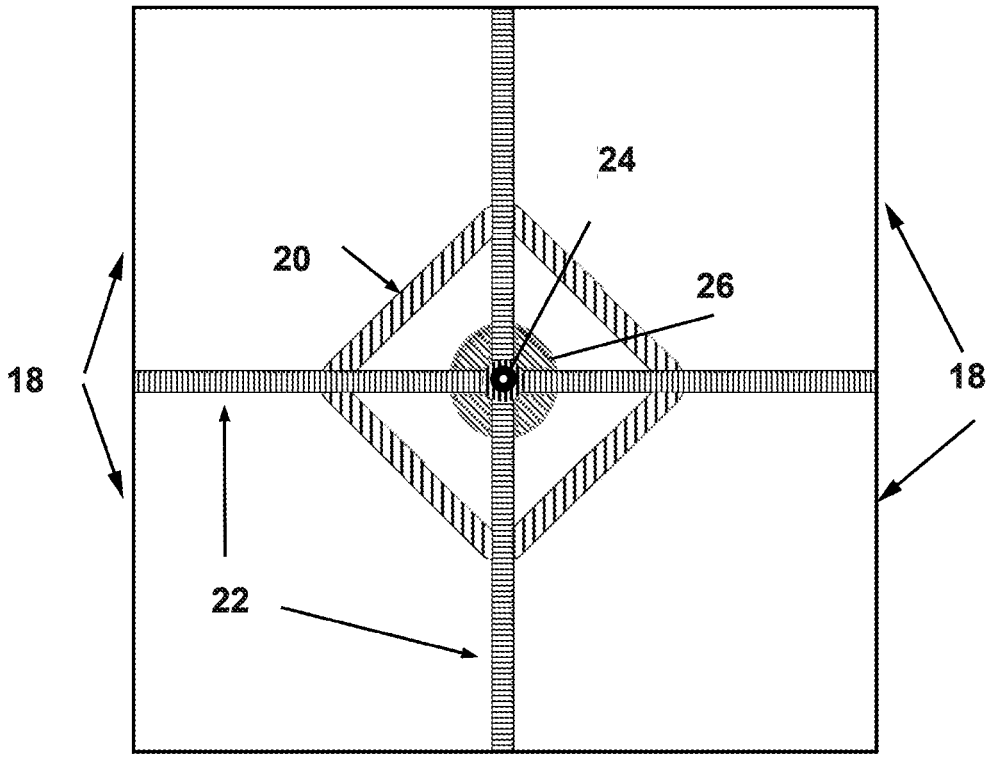
FIG. 3 is a top view of four ballasted pavers in a grid formation prior to placement of the paver lock.

FIG. 3 is a top view of four ballasted pavers 18 in a grid formation prior to placement of the paver lock.

The current embodiment shows paver grooves 20, paver seams 22 and a paver corner hole 24.

When the paver lock is affixed to the four pavers 18, the components of the paver lock are configured to correspond to components of the paver so that the paver lock fits snugly, with a minimum of visibility.

In a preferred embodiment, the upper frame 10 dimensions correspond to the size of the paver groove 20 so that the upper frame 10 sits within the paver grooves 20 on a multiple of pavers 18.

Although the top for the upper frame 10 can be at any height in relation to the paver surface, the preferred height of the upper frame 10 should be flush or below so the paver surface across the patio or deck surface because an upper frame 10 that is higher than the paver surface can cause a trip hazard.

The width of the paver groove 20 can be equal to, or greater than the width of the upper frame 10. A snug fit will minimize pooling water that can attract breeding insects and lessen the debris or other detritus from settling in the space.

In the displayed embodiment, the paver grooves 20 create a diamond shape and are cut or molded into the pavers at the position on which the upper frame 10 will be set.

The depth of the paver groove is dependent upon the materials used to create the pavers 18. For example, a concrete paver is thicker and heavier than most wood pavers, and allows for deeper paver grooves 20. As well, materials used in the paver lock can also have an effect on the depth of the paver groove 20. For example, a paver lock made from welded steel requires less upper frame 10 high, and therefore paver groove 20 depth, than a lightweight plastic upper frame 10.

Water, oils, or small particulate matter caught in the paver groove 20 can flow downward toward the spacer arms 12 and out onto the roof underneath.

The bottom of the paver groove 20 does not need to be level, and instead can decline from one side of the paver groove 20 to its opposite side, or from a position within the paver groove 20, declining outward toward the spacer arms 12. The corresponding paver groove 20 should match the decline so that the bottom of the upper frame makes contact at a plurality of points at the bottom of the paver groove 20. Indents or divots in the paver groove 20 should be avoided during manufacture as they can become areas where water and debris can pool.

In an additional embodiment, a paver groove width is greater than a width of the upper frame 10 allowing more water, oils and small particulate matter to enter the paver groove 20 and flow down onto the roof below.

Additionally, those persons skilled in the art should consider the impact the paver groove 20 will have on the strength of the paver 18 at the paver groove 20 location, particularly when deciding on materials and size for a particular geographic location. In some cases, especial when using already fragile materials such as ceramic, the paver groove 20 could be an area that is less stable than the rest of the paver 18. Increased uplift forces from weather events or downward forces caused by heavy foot traffic could cause the paver 18 to crack at the paver groove 20 if the groove is cut or molded too deep, without enough material below the paver groove to maintain sufficient strength to counteract these forces.

It should be noted that forces acting upon the pavers 18, such as foot traffic, uplift wind or the shockwave from an earthquake, will rarely create a uniform pressure across the paver 18. This means that the combination of the paver 18 and the paver lock should have sufficient strength to withstand the highest expected forces at all points on the paver 18, including potential weak spots such as at the paver groove 20 otherwise the paver 18 may fail.

In the displayed embodiment, four pavers 18 intersect at the corners creating four paver seams 22.

The spacer arms 12 can are placed within the paver seams 22. It is preferred that the spacer arms 12 lie below the surface of the pavers 18, which makes the spacer arms 12 difficult to see, helping to ensure the paver lock has a minimal effect on the aesthetics of the roof deck, while sustaining downward forces.

The number of spacer seams 22 is determined by the shape and placement of the pavers 18. For example, if hexagonal pavers are used, three paver spaces would be created, allowing for a triangular upper frame 10 and three spacer arms 12 connecting to the center connector 14.

In the displayed embodiment, the paver seams 22 are at a 45-degree angle in relation to the paver grooves 20, when viewed from above.

When the paver lock is in place, the spacer arms 12 are fit into the paver seam 22 and so that the spacer arm 12 should be equal to or less than the width of the space between the pavers. The top of the spacer arms 12 can sit below the paver 18 surface for aesthetics.

In a preferred embodiment, the number of spacer arms 12 will correspond to the number of paver seams 22, although the number of spacer arms 12 can be less than the number of paver seams 22.

The paver center connector cutaway 26 will hold the center connector 14.

The paver center connector cutaway 26 is a cutaway area at the corner of each paver, equal to a fraction equal to or greater than—where N is the number of pavers connecting at corners. For example, in the displayed embodiment of four pavers connecting at the corners, the paver center connector cutaway 26 on each of the four pavers 18 is a cutaway equal to ¼ the size of the center connector 14. The paver center connector cutaway 26, therefore, will be equal to or greater than the size of center connector 14.

In a preferred embodiment, the depth of the paver center connector cutaway 26 is equal to or greater than the height of the center connector 14 so that it remains flush or below the paver surface.

Figure 4:
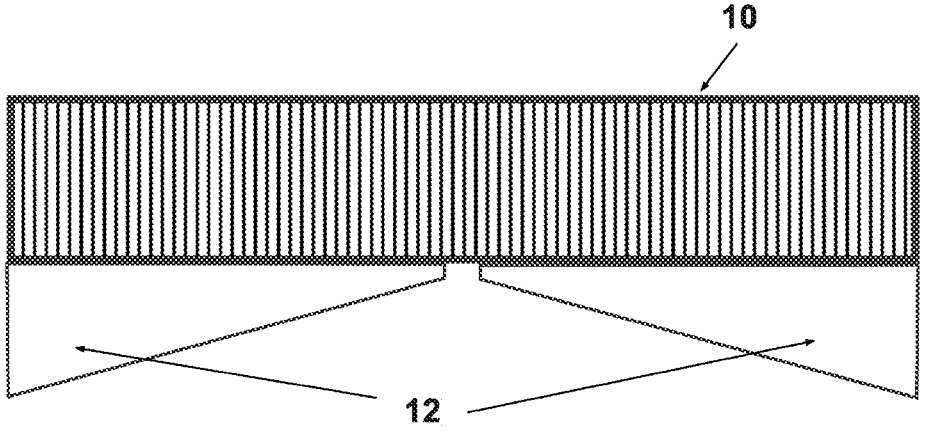
FIG. 4 is a side view of a declining upper frame, with the bottom slanted from the center point outward to the spacer arms.

FIG. 4. shows a side view of a declining upper frame 10, with the bottom slanted from the center point outward to the spacer arms 12. The top of the upper frame remains level so that it remains flush with the paver 18 surface.

Figure 5:
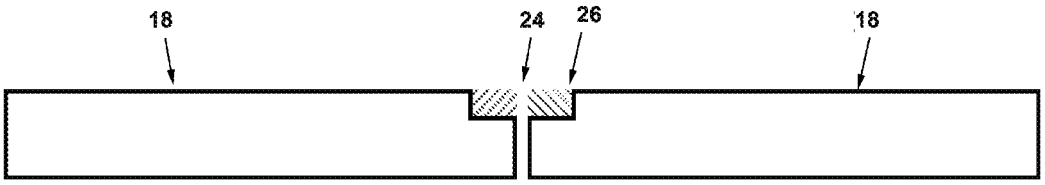
FIG. 5 is a side view of two pavers, with the paver center connector cutaway.

FIG. 5. shows a side view of two pavers 18, with the paver center connector cutaway 26.

Preferably, the paver lock should fit snugly to provide even counterbalance forces, otherwise extra stress on vulnerable paver areas, such as roof corners and escarpments, can occur allowing for a greater potential for paver failure.

As well, properly set pavers can minimize damage from the expansion forces of freezing water and thermal stress, as well as inertial forces from catastrophic events, such as earthquakes.

Once the paver lock is placed onto the paver 18, each paver lock should be affixed to a stationary object through the connector hole 16, so that all the paver locks on the patio or deck are interlocking.

Interlocking systems distribute uplift forces to adjacent pavers to resist uplift forces on the pavers 18.

While the invention contemplates a direct connection to the roof, the most common approach uses a paver pedestal 28.

Figure 6:
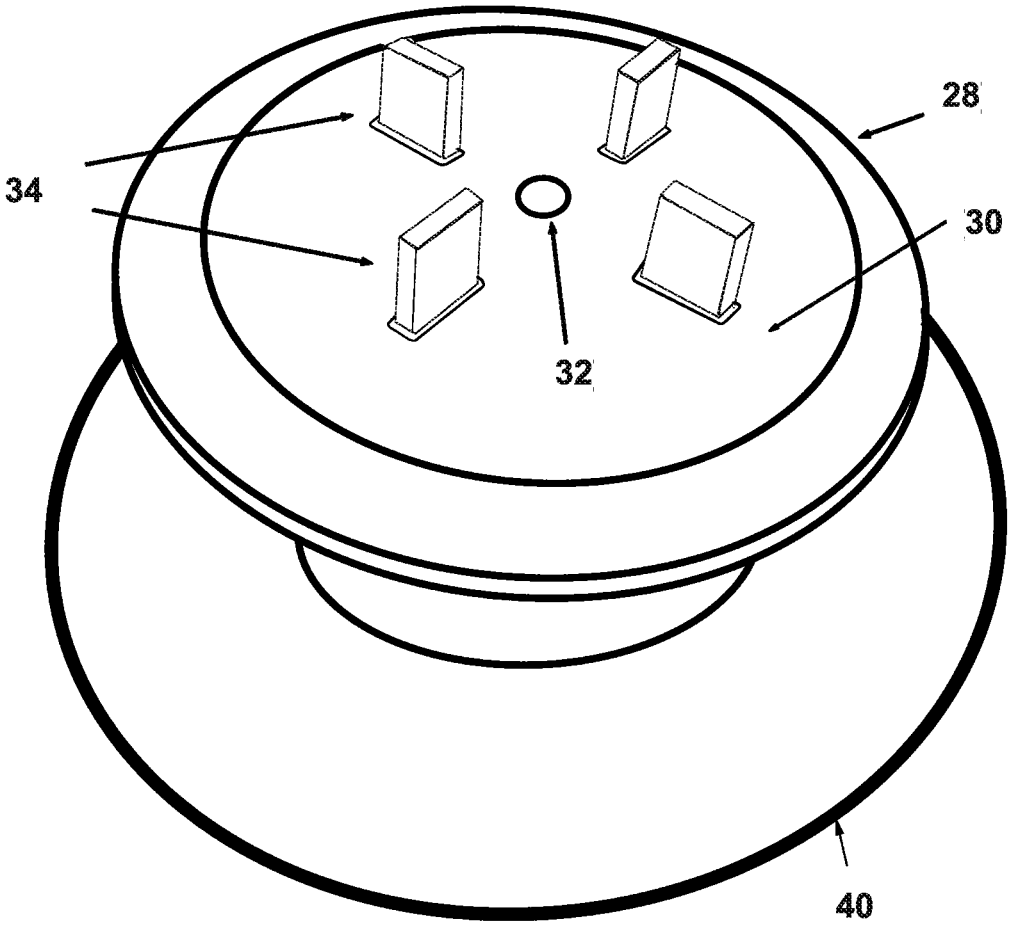
FIG. 6 is a perspective view of a typical paver pedestal.

FIG. 6 shows a typical paver pedestal 28, although the present invention can use a plurality of types of paver pedestals 28 to connect the paver locks together for stability.

The paver pedestal 28 sits on a surface substrate such as a roof. In a typical ballasted roof paver system, the paver pedestal 28 is not permanently affixed to the roof. However, if additional counterbalancing forces are required, paver pedestals 28 can be permanently affixed to the surface substrate before connecting the paver lock.

Pavers are loose laid on the upper pedestal 30. In order to evenly align the pavers so each is an equal distance from the center of the upper pedestal 30, paver dividers 34 can be used.

The paver pedestal 28 displayed in FIG. 6 is configured to accommodate four pavers 18 in a uniform grid pattern. The paver dividers 34 guide the paver 18 placement, with the corner of each paver located at the center of the paver pedestal 28, with the paver sides separated by the paver dividers 34.

The thickness of the paver dividers 34 is equal to or less than the width of the paver seam 22.

A pedestal hole 32 sits directly below the connector hole 16 through which the paver lock will be connected to the paver pedestal 28.

The paver pedestal 28 is loose laid on the roof but can be affixed to the roof, for example, by bolting it down.

Figure 7:
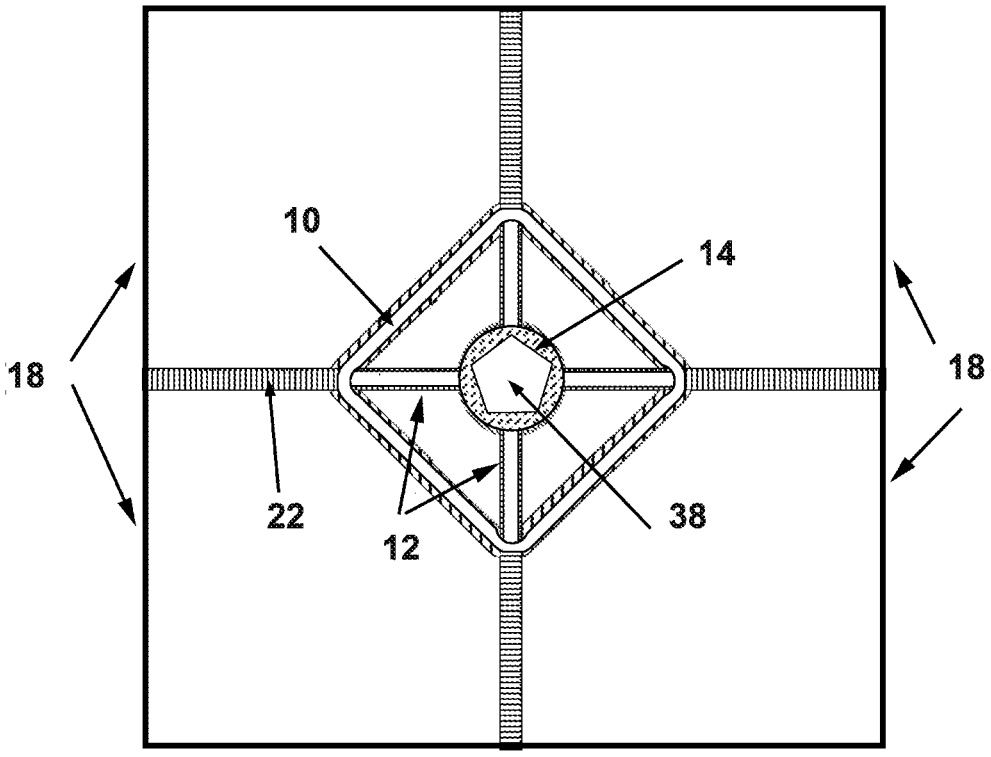
FIG. 7 is a top view of four pavers with a paver center connector cutaway with the paver lock in place.

FIG. 7 shows a top view of four pavers 18, with the paver lock in place.

From the top view, the upper frame 10 is visible flush with the paver surface, and creates a diamond pattern at the intersection of four pavers 18.

The spacer arms 12 sit in the paver seams 22 at a lower depth to minimize their visibility from the deck or patio surface.

In the center, placed over the paver center connector cutaway 26 is the center connector 14. The connector bolt 38 is placed above the paver center connector cutaway 26 and connects the paver lock to the paver pedestal 28.

In the preferred embodiment, a screw apparatus is used but any mechanism that allows for both attaching the paver lock to the pedestal and removing the attachment is contemplated.

Figure 8:
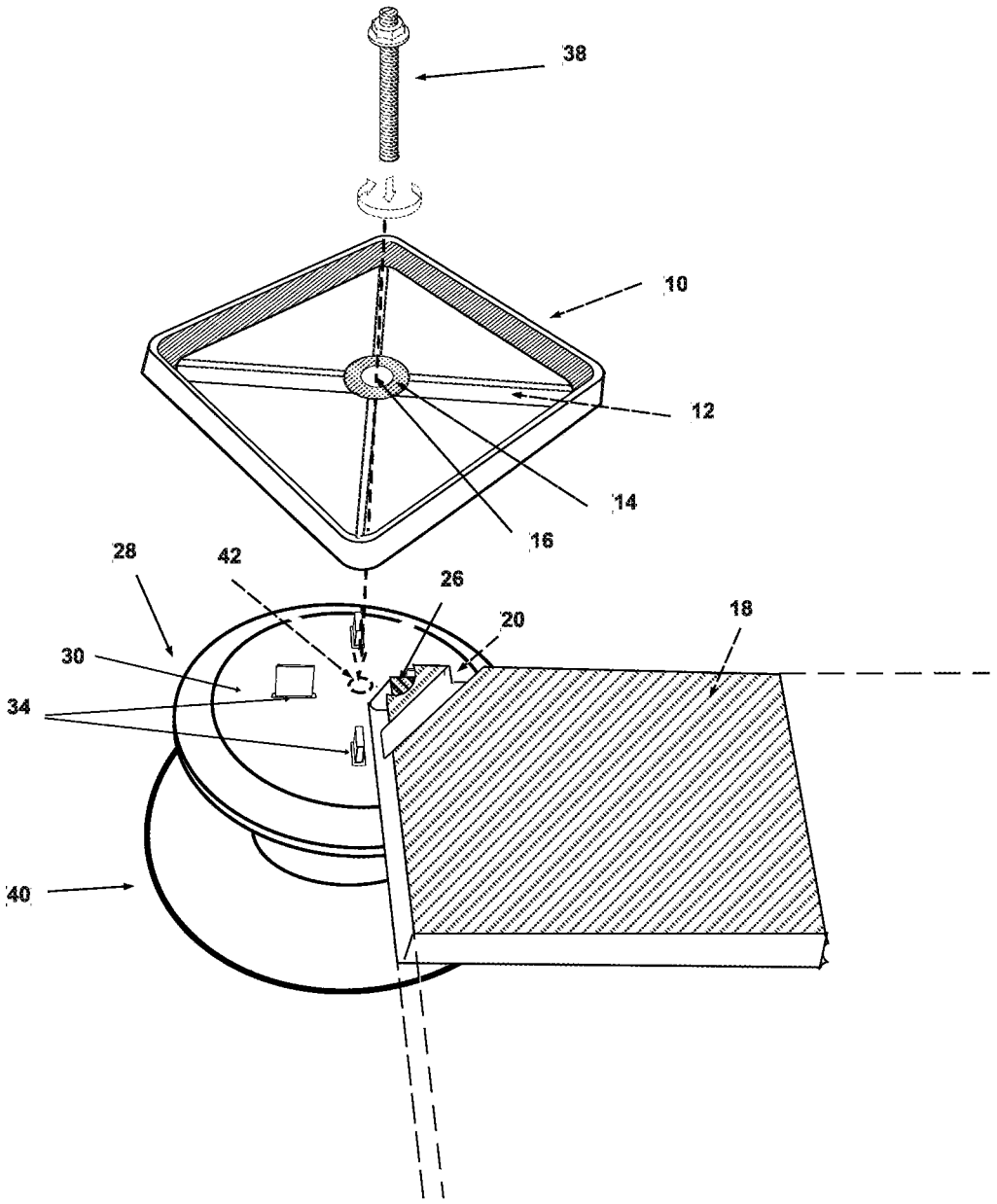
FIG. 8 an exploded, perspective view of the paver lock, paver and paver pedestal.

FIG. 8 illustrates a cross view of the paver lock, pavers 18 and paver pedestal 28 detailing how the paver lock attaches to the various components. In the presented embodiment, the paver pedestal bottom 40 sits, unattached, on the surface substrate. The paver 18 (along with three additional pavers not seen here), lie loose on the upper pedestal 30 and is guided into position by the paver dividers 34. Each paver 18 has a paver groove 20 and a paver center connector cutaway 26.

The upper frame is situated in the paver groove 20 and the spacer arms 12 are positioned in the paver seam 22. The center connector 14 is situated in the paver center connector cutaway 26. Both the spacer arms 12 and the center connector 14 sit below the topside elevation of the pavers in this display.

Finally, the connector bolt 38 is situated in the connector hole 16 and attached to the paver pedestal 28 through pedestal connection hole 42. The top of the connector bolt 38 is flush with, or below the topside of the paver 18 after it is screwed into the paver pedestal 28, creating a uniform surface across the deck without a raised obstruction that can cause a trip hazard.

Figure 9:
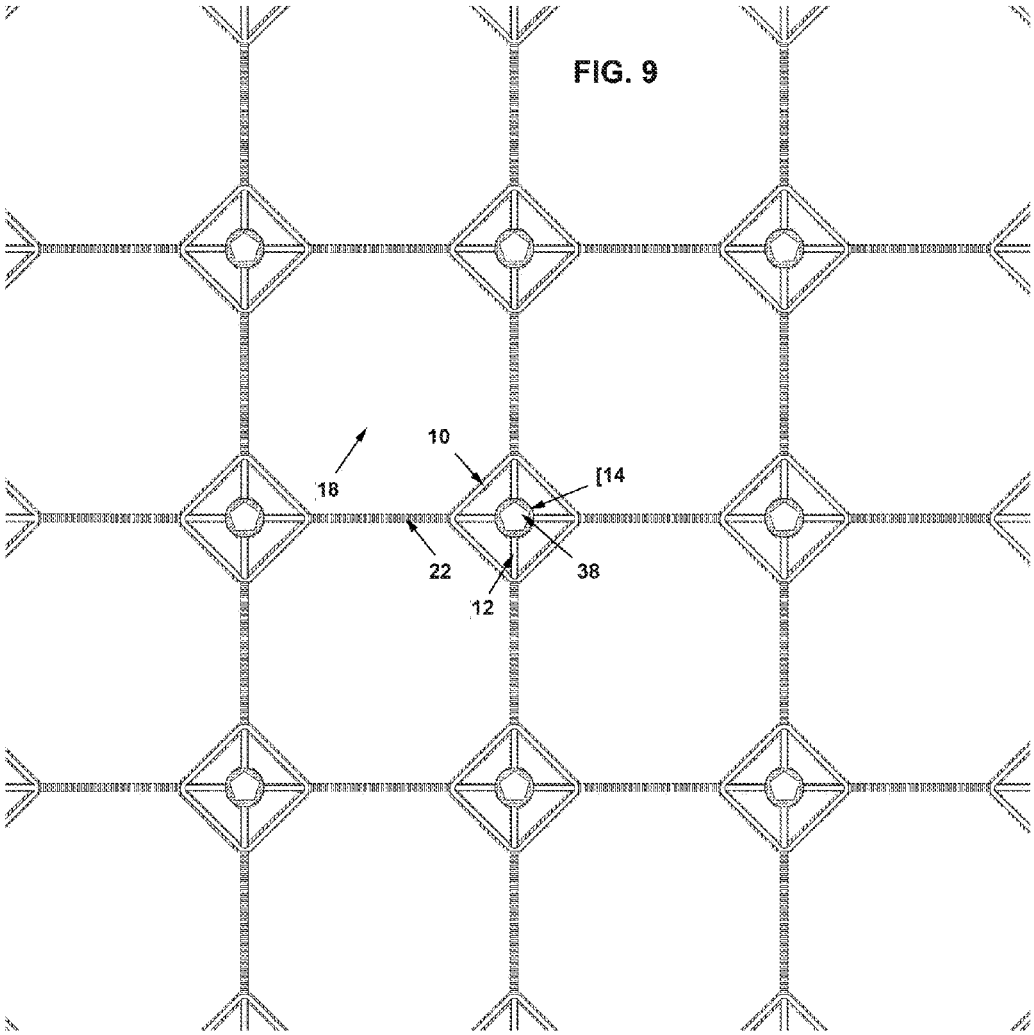
FIG. 9 is a top view of a roof deck with a multiplicity of pavers and paver locks.

FIG. 9 shows a top view of a roof deck with a multiple of pavers 18 and paver locks. From this top view can be seen the connector bolt 38 which has been fed through the connector hole 16 in the center connector 14. The center connector 14 and the connector bolt 38 are shown situated in the paver center connector cutaway 26 of four adjacent pavers 18. Between the pavers are the paver seams 22 which hold the spacer arms 12 unseen here as they are below the surface. Set into the paver grooves 20 on a multiple of pavers 18 is the upper frame 10.

The method for deploying the roof paver locking system has three steps, 1) manufacture of the pavers 18, 2) manufacture of the paver lock, and 3) the placement of the pavers 18 and the paver lock.

In a preferred embodiment, the paver 18 is manufactured with a paver center connector cutaway 26 and a paver groove 20, as described earlier.

Although the present method contemplates a number of manufacturing processes, the preferred methods for producing the paver 18 that includes a paver center connector cutaway 26 and paver grooves 20 is to either cut the paver center connector cutaway 26 and paver grooves 20 after the paver 18 is already manufactured or include the paver center connector cutaway 26 and the paver grooves 20 as part of a mold.

For example, the paver center connector cutaways 26 and paver grooves 20 in wood pavers would likely be cut out of the paver 18. In a concrete paver, concrete is poured into a mold containing raised portions equivalent to the both the size and shape of the paver center connector cutaway 26 and the paver groove 20.

The method for manufacturing the paver lock is also dependent on factors, such as desired materials, expected environmental conditions and paver 18 materials.

Where the paver lock is a made of a polymer, for example, production may use an injection molding process or 3D printing and where the paver lock is made of a non corrosive metal, like stainless steel, the paver lock may be formed using techniques such as such as roll forming, press forming, forging, press drawing, and extrusion.

To lay a patio or deck, a preferred method places paver pedestals 28 in positions throughout the patio or deck area, below the estimated position of the paver center connector cutaways 26 and the paver lock's center connector 14.

In the preferred method, the pavers are loose laid onto the paver pedestals.

In one embodiment the paver dividers 34 are used to guide the paver 18 into place.

Once a set of pavers 18 are laid and can be locked to the paver pedestal 28, the paver lock is loose laid such that the center connector 14 is placed in the paver center connector cutaway 26, the spacer arms 12 are placed in the paver seams 22, and the upper frame 10 is placed into the paver grooves 20.

While the pavers lock can be fastened once laid into place, it is recommended that the continuous patio or deck be laid and all paver locks placed before locking to allow for adjustments to the patio or decks position.

Although any method for securing the paver lock to a paver pedestal 28 is contemplated, the preferred method is to feed a connector bolt 38 through the connector hole 16, through the paver corner hole 24 and into the pedestal connection hole 42 and tightened.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A paver locking system, comprising:

at least three pavers of a symmetrical polygonal shape with at least one side adjacent to a side of another one of said pavers to create a paver seam;

a paver lock having an open geometric shaped upper frame, a center connector and at least two spacer arms extending from a point on said upper frame to said center connector, said center connector disposed centrally within said upper frame and having a connector hole formed therein, said spacer arms each having an upper surface, said upper frame having an upper surface disposed above said upper surface of each of said spacer arms in a vertical direction; and a fastener having a length and width sufficient for fitting inside and through said connector hole of said center connector and said fastener configured for fastening to a stationary object.

2. The paver locking system according to claim 1, wherein said paver lock is made from a molded polymer.

3. The paver locking system according to claim 1, wherein said paver lock is made from a non-corrosive metal.

4. The paver locking system according to claim 1, wherein:

each of said pavers has a groove formed diagonally spanning between two sides of a respective paver, said two sides ending at a vertex of said respective paver; and each of said pavers having a center connector cutaway formed therein in place of a tip of said vertex, said center connector cutaway being discontinuously spaced from said groove.

5. The paver locking system according to claim 4, wherein:

said pavers each have a top surface;

said upper frame has a shape corresponding to said groove on each of said pavers; and said upper frame fits into said groove on each of said pavers and said upper frame has a top surface being flush with or below said top surface of said pavers.

6. The paver locking system according to claim 5, wherein said spacer arms have a width being sufficient to fit in said paver seam formed between two adjacent ones of said pavers and a top of said spacer arms is below said top surface of said pavers.

7. The paver locking system according to claim 1, wherein:

each of said pavers has a top surface; and said center connector has a size being sufficient to fit into said center connector cutaway of said pavers and said fastener has a top disposed below said top surface of said pavers.

8. The paver locking system according to claim 1, wherein said fastener is a connector bolt fastened to a paver pedestal through a pedestal hole at a top of the paver pedestal.

9. The paver locking system according to claim 4, wherein:

said groove is slanted toward said paver seam; and said upper frame having a bottom being slanted so that said bottom of said upper frame contacts a bottom of said groove at a plurality of points.

10. The paver locking system according to claim 9, wherein said groove has sides being slanted away from said upper frame to create a channel that reduces liquid pooling on a surface of said pavers.

11. The paver locking system of according to claim 4, wherein:

said at least three pavers is three of at least four roof pavers each supported by four pedestals, and one vertex of each of said four roof pavers is set on a quadrant on a surface of one of the pedestals, leaving a pedestal center connector hole exposed;

said upper frame is placed over said roof pavers, said connector hole of said center connector is aligned with the pedestal center connector hole, and said upper frame is placed within said groove of each of said roof pavers; and said fastener is inserted through said connector hole and into the pedestal center hole where said fastener is fixed in place, but removable, securing said four roof pavers to one of the pedestals without said paver lock physically touching the pedestals.

12. The paver locking system according to claim 1, further comprising a paver pedestal having a pedestal hole formed therein, said fastener is a connector bolt fastened to said paver pedestal through said pedestal hole at a top of said paver pedestal.

13. A method for setting and securing pavers on a roof while leaving a space between a roof surface and a bottom of the pavers, which method comprises the steps of:

providing a paver having a paver groove formed therein and diagonally spanning between sides of at least one vertex and a center connector cutaway formed therein in place of a tip of the vertex;

providing a paver lock having an open geometric shaped upper frame, a center connector and at least two spacer arms extending from a point on the upper frame to the center connector at a center of the upper frame, the spacer arms each having an upper surface, the upper frame having an upper surface disposed above the upper surface of each of the spacer arms in a vertical direction;

loose laying corner vertices of at least two pavers onto paver pedestals, wherein the pavers are adjacent to each other and a pedestal hole on top of a pedestal is accessible;

loose laying the paver lock onto the at least two pavers wherein the upper frame sits in paver grooves and the spacer arms sit in paver seams formed between two adjacent ones of the pavers; and placing a fastener through the connector hole and fixing the fastener to the pedestal hole and locking the pavers between the paver lock and the pedestal.

14. A method of setting and securing pavers on a roof while leaving a space between a roof surface and a bottom of the pavers, which comprise the steps of:

cutting a paver groove in a paver diagonally spanning between sides of at least one vertex;

cutting a center connector cutaway in place of a tip of the vertex;

providing a paver lock having an open geometric shaped upper frame, a center connector and at least two spacer arms extending from a point on the upper frame to a center connector at a center of the upper frame and the center connecter having a connector hole formed therein, the spacer arms each having an upper surface, the upper frame having an upper surface disposed above the upper surface of each of the spacer arms in a vertical direction;

loose laying corner vertices of at least two pavers onto paver pedestals, wherein the pavers are adjacent to each other and a pedestal hole on top of a pedestal is accessible;

loose laying the paver lock onto the at least two pavers wherein the upper frame sits in paver grooves and the spacer arms sit in paver seams formed between adjacent pavers; and placing a fastener through the connector hole and fixing the fastener into the pedestal hole and locking the pavers between the paver lock and the pedestal.

15. A paver lock for engaging into a groove of a paver for locking the paver to a stationary object, the paver lock comprising:

an open geometric shaped upper frame having an upper surface;

a center connector disposed centrally within said upper frame and having a connector hole formed therein;

at least two spacer arms extending from a point on said upper frame to said center connector, said spacer arms having upper surfaces disposed below said upper surface of said upper frame in a vertical direction; and a fastener having a length and width sufficient for fitting inside and through said connector hole of said center connector, said fastener configured for fastening to the stationary object.

16. The paver lock according to claim 15, wherein said upper frame is square, rectangular or circle shaped and has an empty interior surface area.

17. The paver lock according to claim 15, wherein:

said upper frame securing a plurality of pavers;

adjacent ones of the pavers secured with said upper frame each define a paver seam there-between; and a number of said spacer arms being equal to a number of paver seams.

18. The paver locking system according to claim 1, wherein said spacer arms extends into said paver seam below a physical level of said upper frame.

19. The paver locking system according to claim 1, wherein said spacer arms extends from said upper frame and only below a physical level of said upper frame.

20. The paver locking system according to claim 1, wherein each of said spacer arms extend into and are positioned in a respective said paver seam below a surface of said pavers.

* * * * *